United States Patent [19]

Zeller, Jacques et al.

[11] Patent Number: 4,736,604

[45] Date of Patent: Apr. 12, 1988

[54] HOUSING HAVING A FLEXIBLE CORD FOR CONNECTING SAID HOUSING TO A LIVING OBJECT OR TO AN INANIMATE OBJECT

[75] Inventors: Zeller, Jacques, Bures Sur Yvette; Claude Morin, La Celle Saint Cloud, both of France

[73] Assignee: D'Automatisme CGA-HBS, Paris, France

[21] Appl. No.: 25,045

[22] Filed: Mar. 12, 1987

[30] Foreign Application Priority Data

Mar. 12, 1986 [FR] France ..... 86 03529

[51] Int. Cl.[4] ..... A44B 15/00; B65D 27/30

[52] U.S. Cl. ..... 70/457; 292/317; 439/894

[58] Field of Search ..... 70/457; 292/307 R, 317, 292/319; 439/511, 577, 894

[56] References Cited

U.S. PATENT DOCUMENTS 2,631,449 3/1953 Protsman ..... 70/457

*Primary Examiner*—Gil Weidenfeld
*Assistant Examiner*—Gary F. Paumen
*Attorney, Agent, or Firm*—Sughrue, Mion, Zinn, Macpeak & Seas

[57] ABSTRACT

A housing (20) provided with a flexible cord (10) for connecting said housing to a living object or to an inanimate object, said housing receiving a plug (30) including two through cavities (31A, 31B) each of which receives a tag (11A, 11B) fixed to a corresponding end of the flexible cord, said housing including two shoulders (24A) each serving as an abutment for a corresponding one of the tags, said abutments ensuring, once the plug has been fully inserted into the housing, that both ends of the cord are definitively retained in the housing, said housing further including an abutment (34) defining an end-of-insertion position for the plug.

3 Claims, 2 Drawing Sheets

HOUSING HAVING A FLEXIBLE CORD FOR CONNECTING SAID HOUSING TO A LIVING OBJECT OR TO AN INANIMATE OBJECT

The invention relates to a housing provided with a flexible cord enabling said housing to be connected to a living object or to an inanimate object, said housing receiving a plug having two transverse cavities each receiving a tag fixed to a respective end of the flexible cord.

BACKGROUND OF THE INVENTION

U.S. Pat. No. 2,631,449 describes a key-holder of this type capable of carrying a plurality of keys.

It describes a housing in the form of a sleeve or tube which is open at both ends and into which a plug is inserted, the plug including two side cavities each receiving a respective tagged end of a flexible cord. These two tagged ends are disposed face-to-face and the cord forms a loop at each end of the key-holder by running lengthwise through the sleeve in a longitudinal groove provided in the plug.

The plug is held in the sleeve by means of a screw of a resiliently-mounted button.

The assembly is easy to disassemble.

The aim of the present invention is to connect the housing to an object which is to be identified, said object being, for example, a key, or a tool. If the object is a living object it may be a person or an animal.

Thus, the invention must ensure that the cord is held fast in the housing and also that the cord cannot be disassembled so as to ensure that the housing cannot be separated from the associated object, be it living or inanimate. This is not true of the above-mentioned document which is specifically designed to be dismountable.

SUMMARY OF THE INVENTION

The present invention provides a housing provided with a flexible cord for connecting said housing to a living object or to an inanimate object, said housing receiving a plug including two through cavities each of which receives a tag fixed to a corresponding end of the flexible cord, said housing including two shoulders each serving as an abutment for a corresponding one of the tags, said abutments ensuring, once the plug has been fully inserted into the housing, that both ends of the cord are definitively retained in the housing, said housing further including an abutment defining an end-of-insertion position for the plug.

Advantageously the housing includes snap-fastening means suitable for co-operating with first and second projections on the plug to define a first position in which one of the tags on the flexible cord is retained in the housing and a second position in which both tags on the flexible cord are retained in the housing.

The housing may include two electrical contacts which are put into electrical connection with each other by the plug when fully inserted in the housing.

BRIEF DESCRIPTION OF THE DRAWINGS

An embodiment of the invention is described below with reference to the accompanying drawings which show a housing in accordance with the invention for use in association with a key, the housing therefore serving as a key-holder. In the drawings.

MORE DETAILED DESCRIPTION

Figure 1:
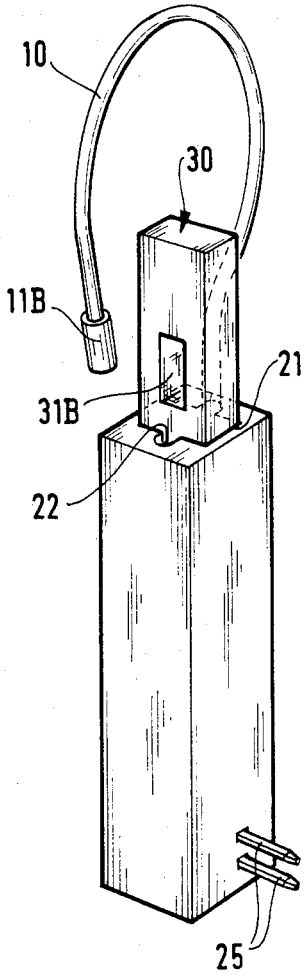
FIG. 1 shows a key-holder provided with a cord having one end already inserted in the plug with the plug shown partially inserted into the corresponding sleeve, the assembly thus constituting a finished product prior to use.

In FIG. 1, a key-holder 20 comprises a body having a blind hole of generally rectangular section formed therein, with a plug 30 of corresponding section being inserted in the hole. The plug has two through cavities, of which only the cavity 31B is visible in FIG. 1. A flexible cord 10 is shown with one end having a tag 11B fixed thereto, e.g. by crimping. The other end of the cord has a corresponding tag 11A fixed thereto which tag is received in the other through cavity 31A in the plug, as can be seen in FIG. 2.

The housing 20 constituting a key-holder in this example has two grooves 22 (only one of which is shown in FIG. 1) running along respective faces of its blind hole for receiving the cord 10 in the housing when the tags 11 are received in the corresponding cavities 31 and the plug is pushed home into the housing.

The housing further includes two electrical contacts 25 capable of being connected to electronic equipment, for example.

Figure 2:
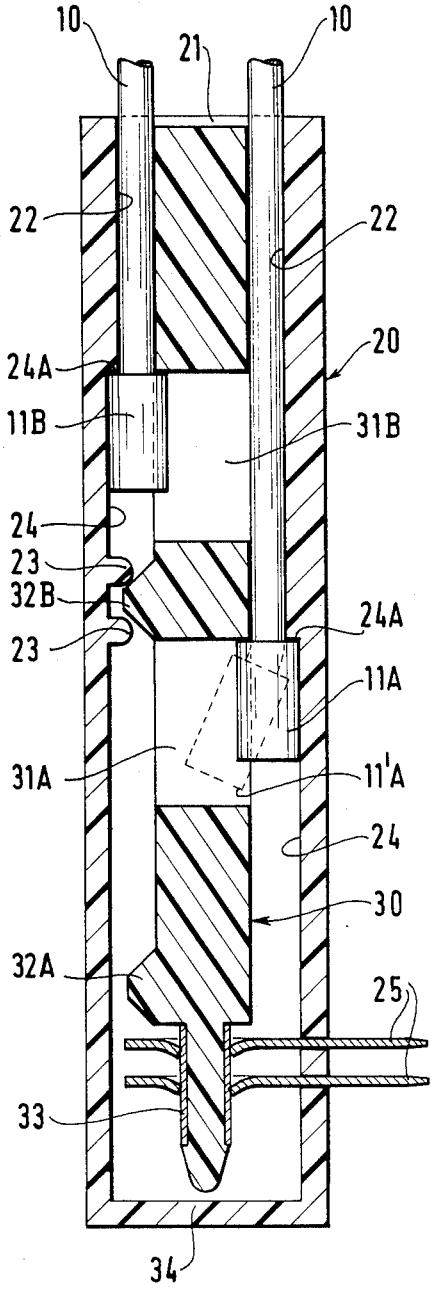
FIG. 2 is a section through the key-holder after it has been closed for use.

In FIG. 2, the plug and the two tags are fully received inside the housing. Dashed lines 11'A show the tag 11A in a position suitable for allowing the cord to pass along one of the grooves 22 in the housing.

A pair of studs 23 co-operte with a first projection 32A on the plug 30 in order to constitute a first snap-fastening effect for positioning the plug in such a position that the tag 11A is held captive tilted into its cavity 31A, as shown by dashed lines 11'A. The key-holder is then ready for delivery to a customer. The two studs 23 also co-operate with a second projection 32B as shown in FIG. 2, thereby providing a second snap-fastening position in which the plug is finally locked in place. While the plug is being inserted into the housing the two projections 32A and 32B run along one of the grooves 22 in the housing 20.

The housing also includes two recesses 24 to enable the tags 11A and 11B to occupy in-line positions after the plug has been snap-fastened in its final position, with the tags then bearing against recess-defining shoulders 24A when traction is applied to the cord, thereby avoiding subjecting the plug to any such tractive force.

The end of the plug 30 includes a metal-clad peg 33 which serves to establish a short circuit between the pair of contacts 25 once the plug is fully home.

FIGS. 3 to 6 show successive stages in assembling the key-holder.

Figure 3:
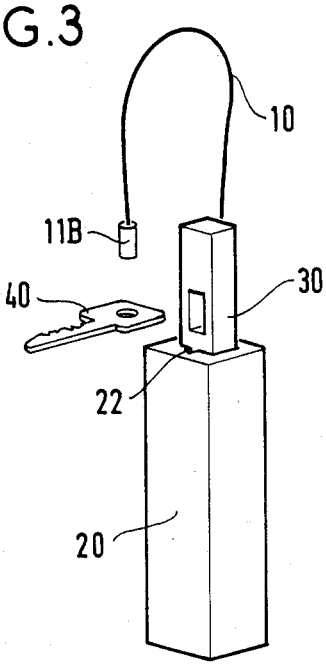
FIGS. 3, 4, 5, and 6 show the sequence of steps whereby the key-holder is attached to a key and is then permanently locked thereto.

FIG. 3 shows the key-holder in the same position as FIG. 1, which is the position in which the key-holder is delivered to customers and already constitutes an inseparable assembly since the first tag is already received in the plug and the plug is snap-fastened in the housing. A key 40 can be attached to the cord 10 when the housing is in this position.

Figure 4:
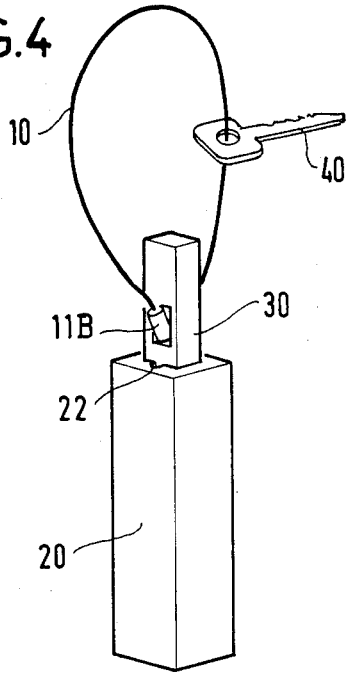

FIG. 4 shows the key 40 threaded over the cord 10 and the second tag 11B being inserted into its cavity 31B in the plug 30.

Figure 5:
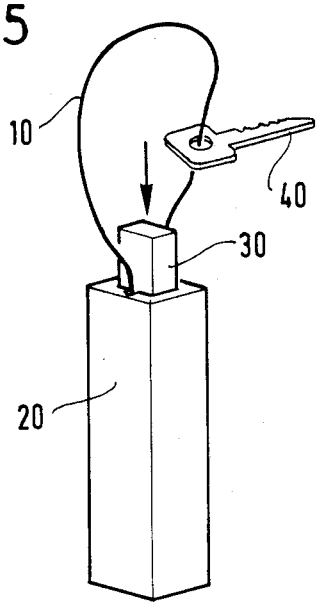

FIG. 5 shows the plug 30 being inserted into the housing 20, with the cord 10 sliding in the grooves 22 in the housing 20.

Figure 6:
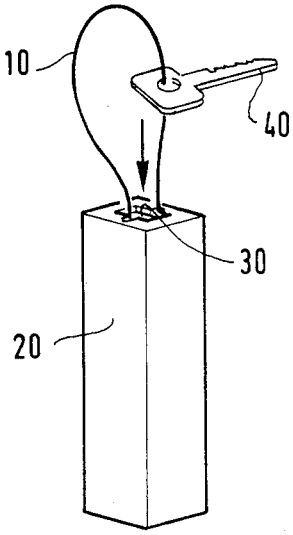

FIG. 6 shows the key-holder in an assembled position, equivalent to that shown in FIG. 2, with the key now being inseparable from the key-holder.

Thus, it can be seen that once the plug 30 and the cord 10 have been pushed fully home into the housing 20 they can no longer be removed therefrom since the plug cannot be withdrawn (upwardly in the drawings) by virtue of the tags 11A and 11B bearing against the shoulders 24A, nor can the plug be pushed out through the other end of the housing since the blind hole in the housing 20 has a bottom 34 which serves as a firm abutment for the plug 30.

We claim:

1. A housing having a longitudinal axis and provided with a flexible cord for connecting said housing to a living object or to an inanimate object, said housing receiving a plug including two through cavities each of which receives a tag fixed to a corresponding end of the flexible cord, said housing including two axially facing shoulders each serving as an abutment for a corresponding one of the tags, said abutments ensuring, once the plug has been fully inserted into the housing, that both ends of the cord are definitively and permanently retained in the housing, said housing further including an abutment defining an end-of-insertion position for the plug.

2. A housing according to claim 1, including snap-fastening means suitable for co-operating with first and second projections on the plug to define a first position in which one of the tags on the flexible cord is retained in the housing and a second position in which both tags on the flexible cord are retained in the housing.

3. A housing according to claim 1 or claim 2, including two electrical contacts which are put into electrical connection with each other by the plug when fully inserted in the housing.

* * * * *